US009568289B2

(12) United States Patent
Macchia

(10) Patent No.: US 9,568,289 B2
(45) Date of Patent: Feb. 14, 2017

(54) FIREWORK LAUNCHING STAND

(71) Applicant: Spot Innovations Inc., Woodbridge (CA)

(72) Inventor: Salvatore Macchia, Woodbridge (CA)

(73) Assignee: Spot Innovations Inc., Woodbridge (CA)

( * ) Notice: Subject to any disclaimer, the term of this patent is extended or adjusted under 35 U.S.C. 154(b) by 0 days.

(21) Appl. No.: 14/476,850

(22) Filed: Sep. 4, 2014

(65) Prior Publication Data

US 2016/0069652 A1 Mar. 10, 2016

(51) Int. Cl.
*F42B 4/00* (2006.01)
*F42B 4/20* (2006.01)

(52) U.S. Cl.
CPC ..... *F42B 4/20* (2013.01)

(58) Field of Classification Search
CPC ..... F42B 4/20
See application file for complete search history.

(56) References Cited

U.S. PATENT DOCUMENTS 350,523 A * 10/1886 Bodley ..... A47K 1/09 211/65
2,053,454 A * 9/1936 Whiteside ..... F42B 4/20 102/358
2,095,490 A * 10/1937 Decker ..... F42B 12/68 102/358
2,376,955 A * 5/1945 Ball ..... A47B 81/005 211/60.1
3,280,744 A * 10/1966 Brown ..... F42B 4/20 102/358
4,688,685 A * 8/1987 Brace ..... A63C 11/028 211/60.1
4,771,695 A * 9/1988 Simpson ..... F42B 4/20 102/343
5,039,052 A * 8/1991 Carafice ..... A47B 81/005 248/156
5,137,319 A * 8/1992 Sauder ..... A01K 97/10 206/315.11
5,626,379 A * 5/1997 Scott ..... A47B 81/005 211/195

(Continued)

FOREIGN PATENT DOCUMENTS

CN 201421297 Y * 3/2010
DE 102005013093 * 11/2005 ..... F42B 4/20
WO WO 03089870 A1 * 10/2003 ..... F41F 3/04

OTHER PUBLICATIONS

Definition of "Strap". American Heritage® Dictionary of the English Language, Fifth Edition. Copyright © 2011 by Houghton Mifflin Harcourt Publishing Company. Published by Houghton Mifflin Harcourt Publishing Company.*

*Primary Examiner* — Gabriel Klein
(74) *Attorney, Agent, or Firm* — Gilbert's LLP; Matthew D. Powell

(57) ABSTRACT

A firework launching stand includes a hub, a plurality of inlets about the periphery of the hub, each inlet having an open mouth at the periphery and tapering inwardly in width, and at least one securing member for temporarily securing to the hub a firework received within a respective inlet. The firework launching stand lends stability during the activation of fireworks such as consumer-grade fireworks for home and recreational use.

16 Claims, 9 Drawing Sheets

(56) References Cited

U.S. PATENT DOCUMENTS

| | | | | |
|---|---|---|---|---|
| 7,559,428 | B2 * | 7/2009 | Matzick | F41A 23/18 211/64 |
| 2003/0070572 | A1 * | 4/2003 | Tang | F41A 19/65 102/349 |
| 2005/0092622 | A1 * | 5/2005 | Whitley | F42B 4/20 206/3 |
| 2005/0133472 | A1 * | 6/2005 | Deye | F42B 4/20 211/60.1 |
| 2005/0252871 | A1 * | 11/2005 | Le Roux | B25H 3/04 211/70.6 |
| 2008/0276820 | A1 * | 11/2008 | Huang | F42B 4/14 102/360 |
| 2011/0017088 | A1 * | 1/2011 | Steadman, Sr. | F42B 4/20 102/358 |
| 2012/0012719 | A1 * | 1/2012 | Manke | G01N 30/6047 248/219.4 |
| 2012/0193254 | A1 * | 8/2012 | Kubiniec | A47B 81/005 206/317 |

* cited by examiner

FIREWORK LAUNCHING STAND

FIELD OF THE INVENTION

Embodiments of the present invention relate generally to accessories for consumer fireworks, and more particular to a firework launching stand.

BACKGROUND OF THE INVENTION

Consumer-grade fireworks made available by retailers/wholesalers/distributors for use by consumers during holiday celebrations and other occasions are well-known and enjoyed by many consumers. Such fireworks are widely available in many retail environments and their distribution is not heavily regulated.

During operation many fireworks emit long streams of hot ashes, or propel multiple hot salvos from generally elongate bodies. The intention is for such fireworks to emit their salvos generally vertically into the air for maximum enjoyment of spectators.

Many consumer-grade fireworks are provided in packaging with other fireworks at low cost to consumers. As separate items ready for activation via ignition, such fireworks do not often have features sufficient for ensuring that the fireworks remain stable on a given surface during operation. For example, many fireworks of a tube configuration have a cylindrical tube that is far longer than its base. When such a firework is placed onto an unstable or uneven surface and activated, the propulsion forces incurred upon activation may cause the firework to tip over such that the cylindrical tube is no longer vertical, even while salvos are still being emitted.

Some fireworks are provided with a small base that is wider than the main body, for providing a small measure of stability. Other fireworks are created without such bases, the intention being that they are to be partially buried in the ground prior to activation. Responsible consumers generally anticipate the risk that a firework may tip over, and take steps to embed the base of a firework into a pile of thick sand, bury it into dirt, or otherwise prepare the ground for providing stability to the firework. However, often the extent to which this is done is insufficient for preventing firework tipping or the surface on which the firework is to be supported is not amenable to such preparation because it is concrete or asphalt based.

As such, with current techniques for stabilizing readily-available consumer-grade fireworks there remains a significant risk of spectator injury. It is an object of an aspect of the following to address this and other disadvantages.

SUMMARY OF THE INVENTION

In accordance with an aspect, there is provided a firework launching stand comprising a hub; at least one inlet at the periphery of the hub, each inlet having an open mouth at the periphery and tapering inwardly in width; and at least one securing member for temporarily securing to the hub a firework received within a respective inlet.

The firework launching stand lends stability during the activation of fireworks such as consumer-grade fireworks for home and recreational use.

The firework launching stand may be constructed of a material such as plastic, or a metal such as steel. In an embodiment, anchoring members such as one or more spikes are provided to assist with temporarily anchoring the hub, and accordingly the fireworks secured to the hub, to the ground.

Other aspects and advantages will become apparent from the following.

BRIEF DESCRIPTION OF THE DRAWINGS

Embodiments of the invention will now be described with reference to the appended drawings in which.

DETAILED DESCRIPTION

Figure 1:
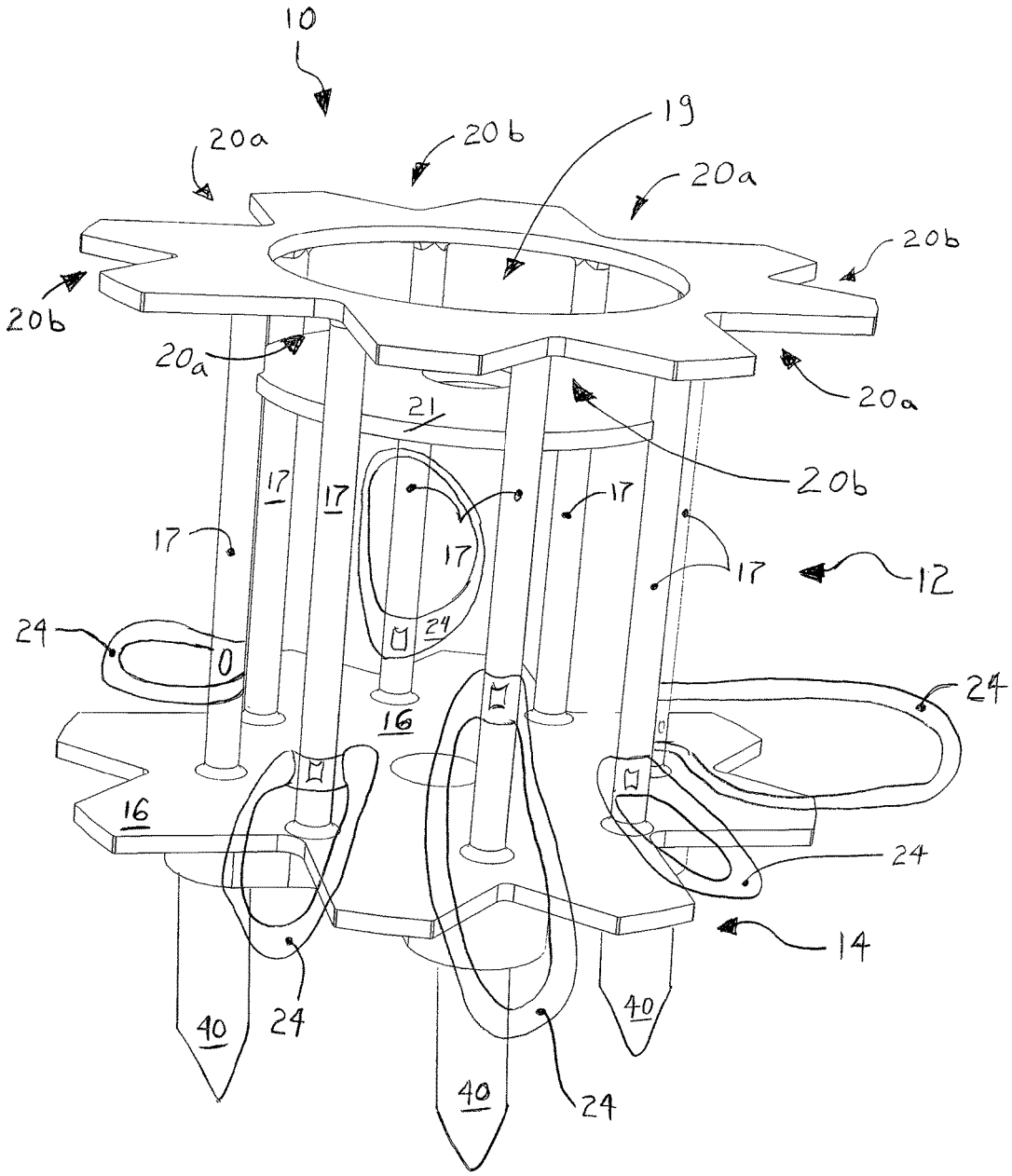
FIG. 1 is a top perspective view of a firework launching stand, according to an embodiment.

Turning to FIG. 1, there is shown a top perspective view of a firework launching stand 10, according to an embodiment. Firework launching stand 10 includes a hub 12 which is, in this embodiment, formed of steel. A plurality of inlets 20*a*, 20*b* are formed in the periphery of the hub, and each of the inlets 20*a* and 20*b* has an open mouth at the periphery that tapers inwardly (i.e., towards the central axis of the hub) in width to a point. In this embodiment, the inlets 20*a*, 20*b* are each generally "V" shaped.

The firework launching stand 10 also includes a number of securing members, in this embodiment straps 24 having hook and loop (i.e., Velcro™) fasteners, for temporarily securing to the hub 12 a generally elongate firework received within a respective inlet, as will be described and shown. Anchoring members, in this embodiment spikes 40, extend from the bottom of hub 12 for securing the firework launching stand 10 to the ground for additional stability. The manner by which spikes 40 are associated with the hub 12 will be described in further detail below.

Figure 2:
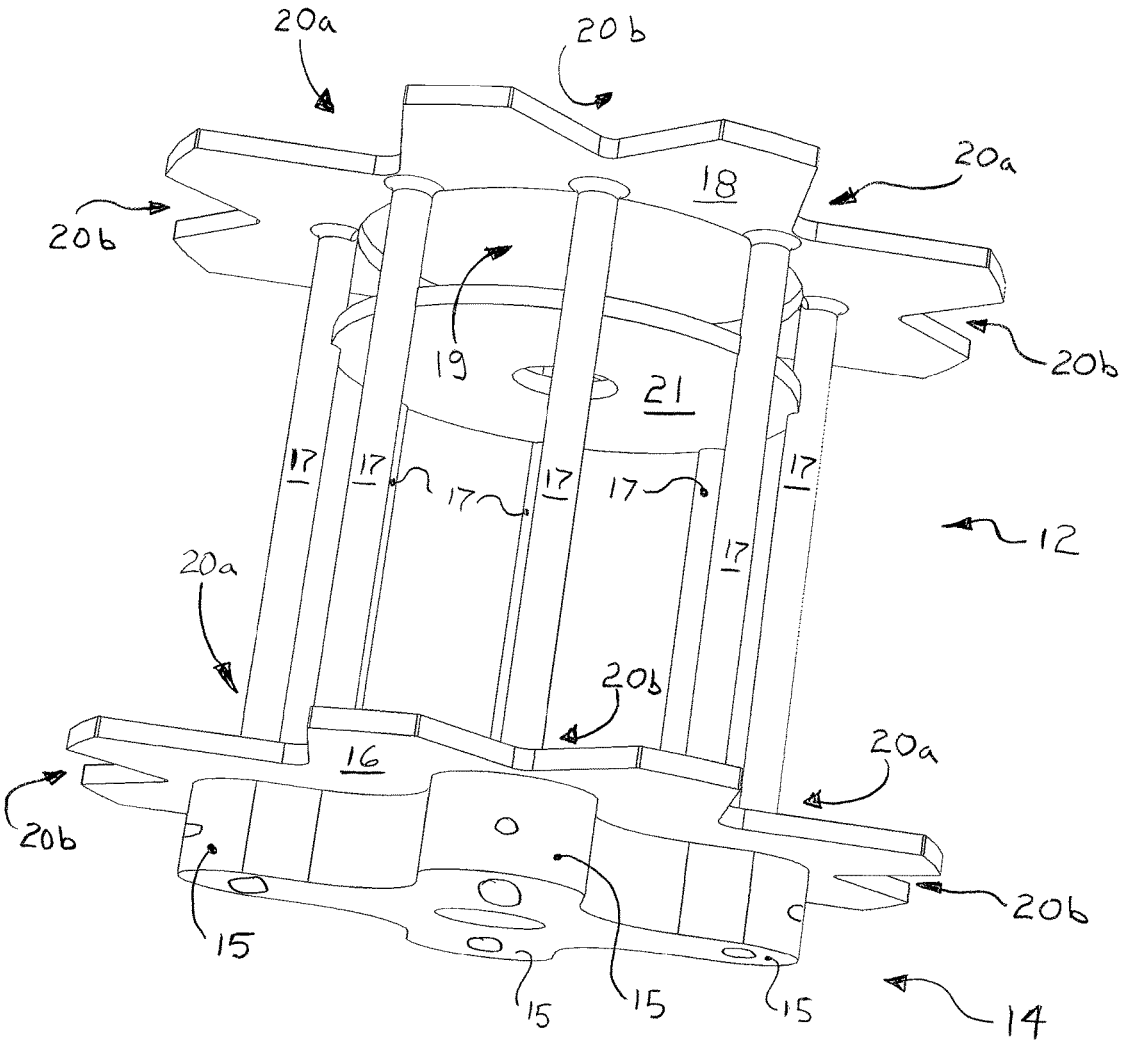
FIG. 2 is a bottom perspective view of the hub of the firework launching stand of FIG. 1.

FIG. 2 is a bottom perspective view of the hub 12 of the firework launching stand 10 shown in FIG. 1, with spikes 40 temporarily removed. The inlets 20*a*, 20*b* are sized to accommodate receiving the side portion of a generally elongate firework, such as a roman candle or other generally tubular or cylindrical firework, as will be shown and described.

Because of their inward taper, different diameters and shapes of firework may be received via the mouths of the inlets 20*a*, 20*b* and seated therein. For example, a slimmer firework will be able to enter further into an inlet 20*a*, 20*b* than would a fatter firework, but either will be received within the inlets 20*a*, 20*b* and will be similarly supported on either side by the walls of the inlets 20*a*, 20*b*.

It is to be noted that, in this embodiment, the mouths of inlets 20*a* are wider than the mouths of inlets 20*b*. The wider mouths of the subset of inlets 20*a* as compared to the mouths of the subset of inlets 20*b* are provided in order to enable firework launching stand 10 to support an increased variety in size of fireworks, as will be shown and described.

In this embodiment, the hub 12 includes a base 14, a lower hub member 16 supported by the base 14 and an upper hub member 18 supported above the lower hub member 16 by a plurality of pillars 17. It is to each pillar 17 that a respective strap 24 is affixed so that, when secured to a firework which the firework is within a respective inlet 20*a* or 20*b*, the firework is affixed to hub 12.

In this embodiment, the lower hub member 16 incorporates a lower portion of each inlet 20*a*, 20*b*, and the upper hub member 18 incorporates an upper portion of each inlet 20*a*, 20*b*, thereby to together receive the side of a respective firework that is at least the same height as hub 12.

In the embodiment shown in FIGS. 1 and 2, base 14 includes a plurality of legs 15 connected to and extending a fixed distance below the lower hub member 16. The legs 15 are positioned underneath the lower hub member 16 such that the lower hub member 16 overhangs the legs where the inlets 20*a* and 20*b* are located. As will be shown, this permits a firework with a wider base to be received snugly within a respective inlet 20*a* or 20*b* along its body without undue interference by the wider base of the firework with the lower hub member 16.

Figure 3:
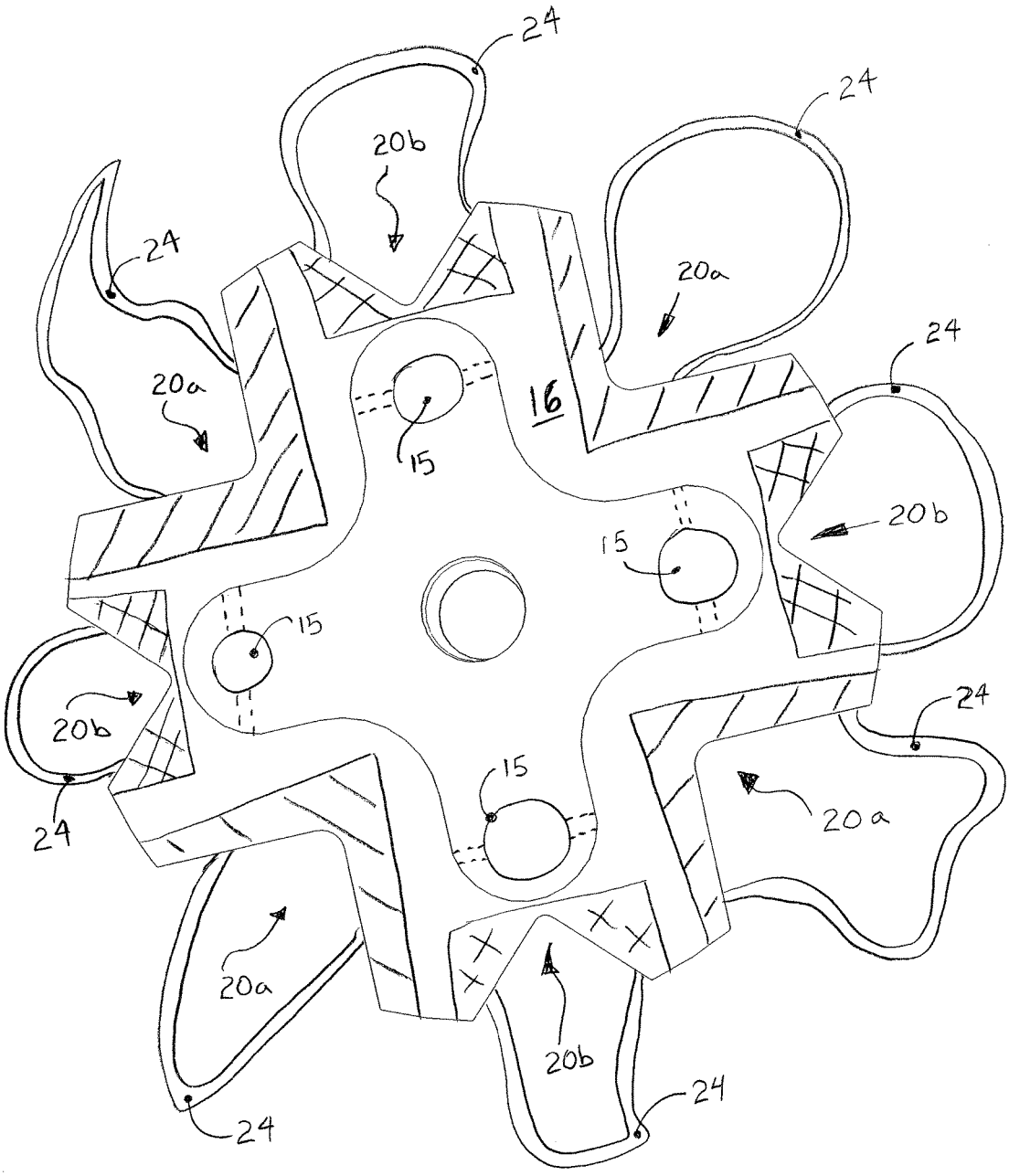
FIG. 3 is a bottom view of the firework launching stand of FIG. 1, with anchoring spikes temporarily removed.

FIG. 3 is a bottom view of the firework launching stand of FIG. 1, with spikes 40 temporarily removed. Each of the legs 15 is dimensioned as a hollow cylinder to removably receive a respective spike 40, such that the spike 40 extends out of the hollow cylinder when received and seated therein.

Figure 4:
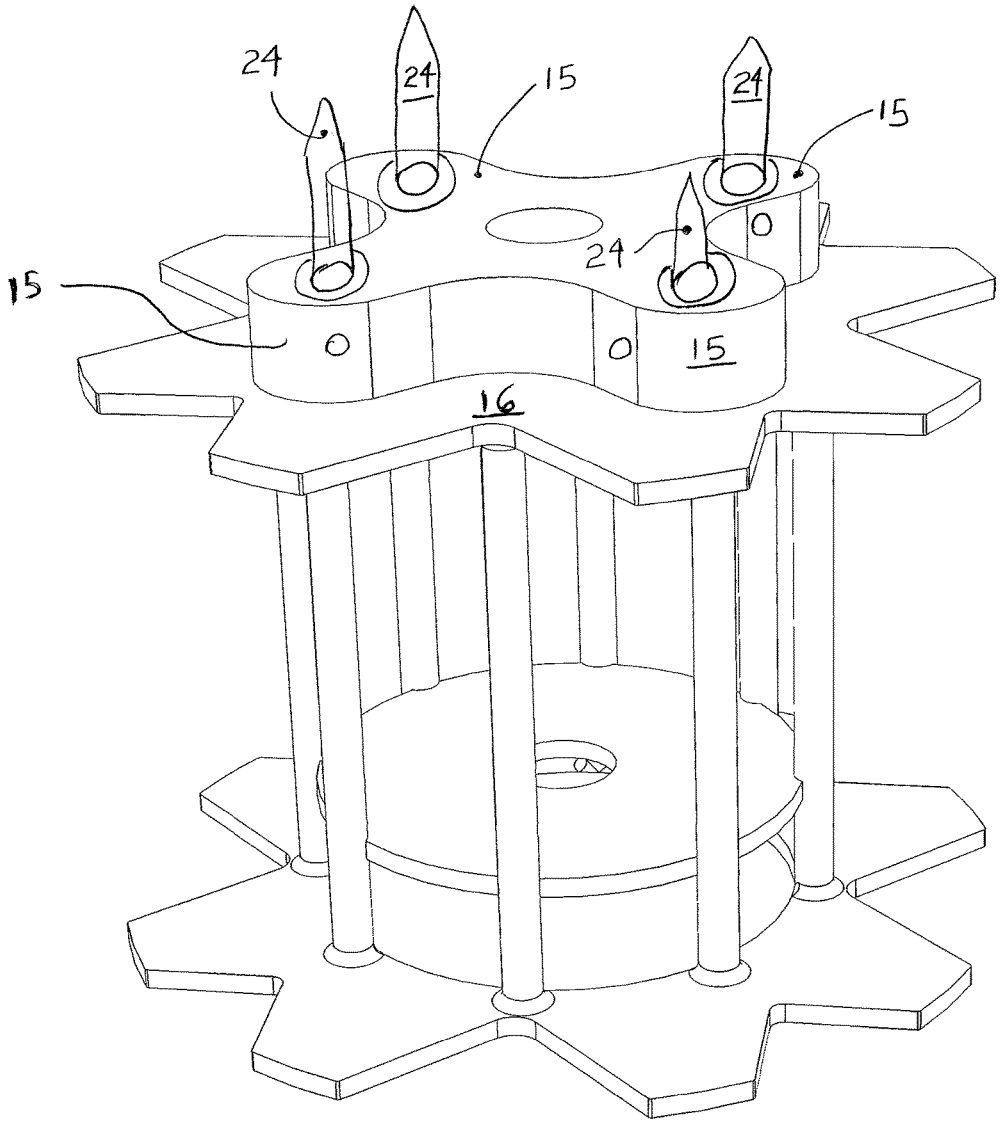
FIG. 4 is a bottom perspective view of the firework launching stand of FIG. 1, with anchoring spikes received therewithin.

FIG. 4 is a bottom perspective view of the firework launching stand 10, with the anchoring spikes 40 received therewithin. As shown, each spike 40 is retained within a respective leg 15 with a cotter pin. Once a spike 40 is inserted into a hollow cylinder leg 15, a cotter pin is slid through a first aperture on the side wall of the leg 15, all of the way through an aperture in the spike 40, and then through a second aperture on the opposite side wall of the leg 15. While the cotter pin is received in this manner, the spike 40 is fixedly connected to the hub 12.

The spike 40 is intended to maintain the firework launching stand 10 in the same position with respect to the ground (or other surface) on which it is sitting so that, even with the forces received from ignited fireworks, the firework launching stand 10 does not significantly shift, move, or tip over. Multiple anchoring members, whether spikes or some other components, may be employed.

Figure 5:
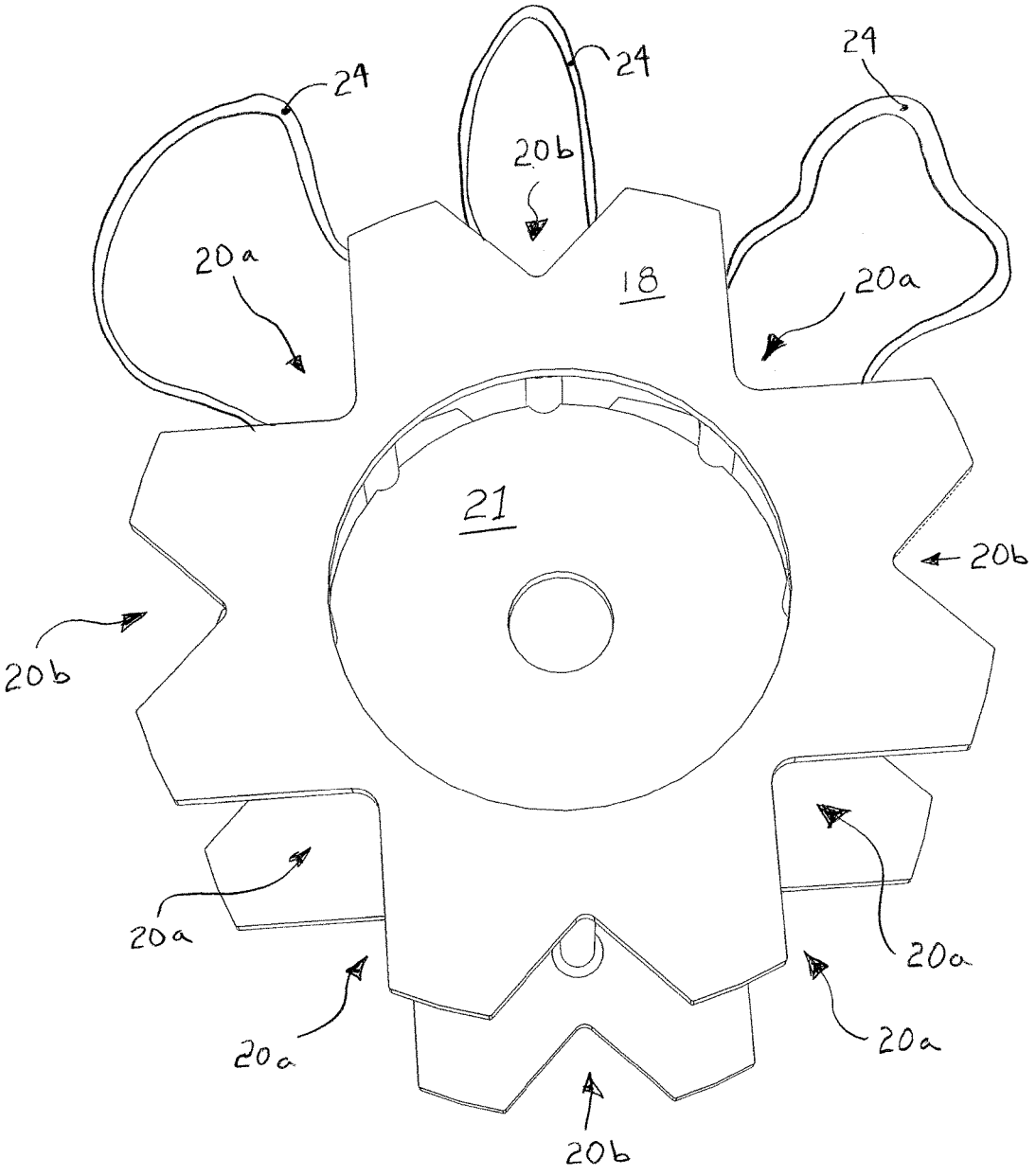
FIG. 5 is a top view of the firework launching stand of FIG. 1.

FIG. 5 is a top view of the firework launching stand 10. In this embodiment, the upper hub member 18 comprises a central opening 19. A platform 21 aligned with and recessed below the central opening 19 is supported by pillars 17. The platform 21 supports one or more fireworks that may be received through the central opening 19, as will be shown.

Figure 6:
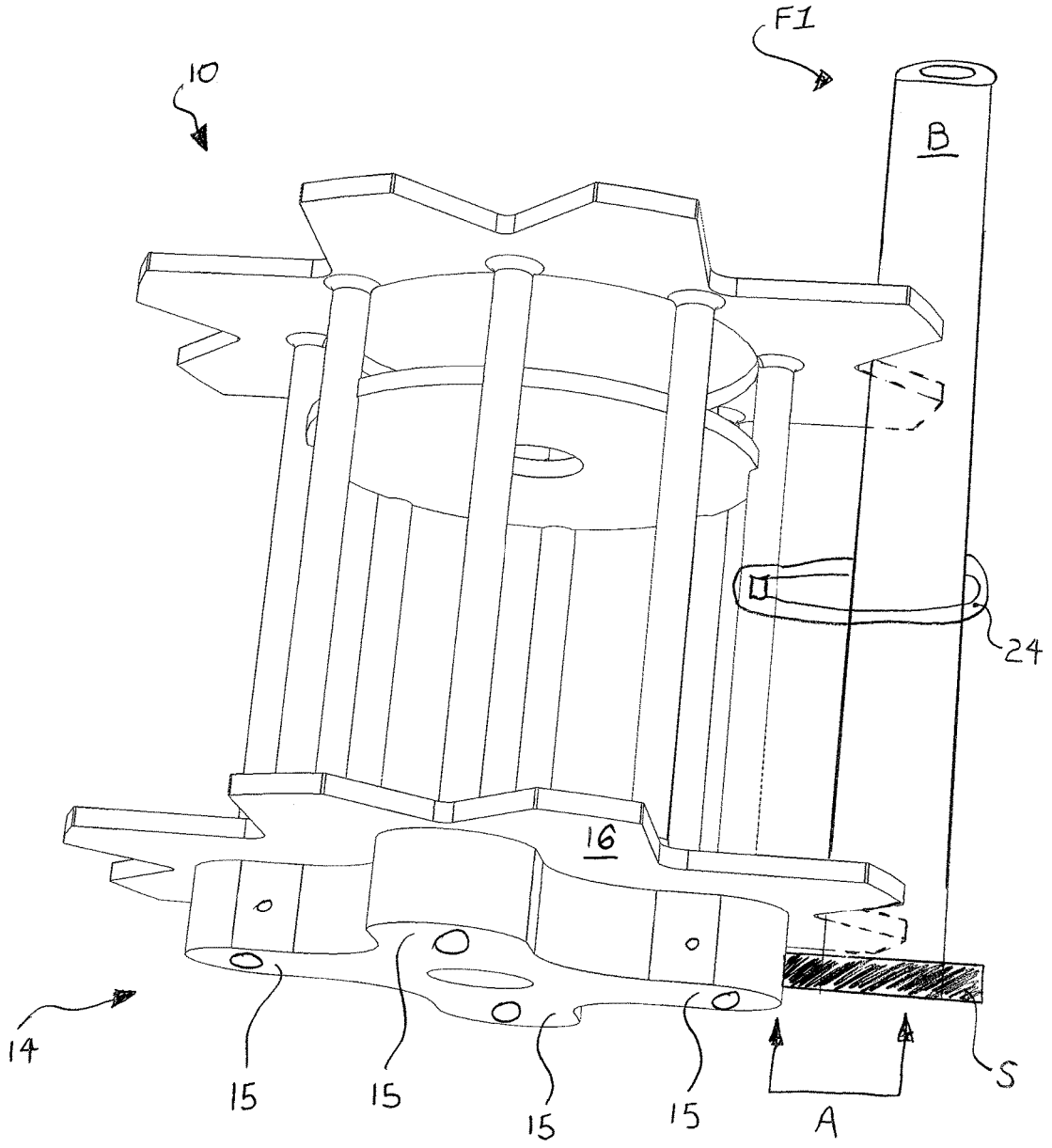
FIG. 6 is a side elevation view of the firework launching stand of FIG. 1, with a firework received within an inlet thereof and secured in place with an securing member.

FIG. 6 is a side elevation view of the firework launching stand 10, with a firework F1 received within an inlet 20*a* thereof and secured in place with a strap 24. The firework F1 has a cylindrical body B that is received within upper and lower portions of an inlet 20*a* and seated against its side walls. It can be seen that the base S of firework F1 is wider than its cylindrical body B, but that the cylindrical body B can be seated within inlet 20*a* because the wider base S is able to fit underneath the area A formed due to lower hub portion 16 overhanging base 14.

Figure 7:
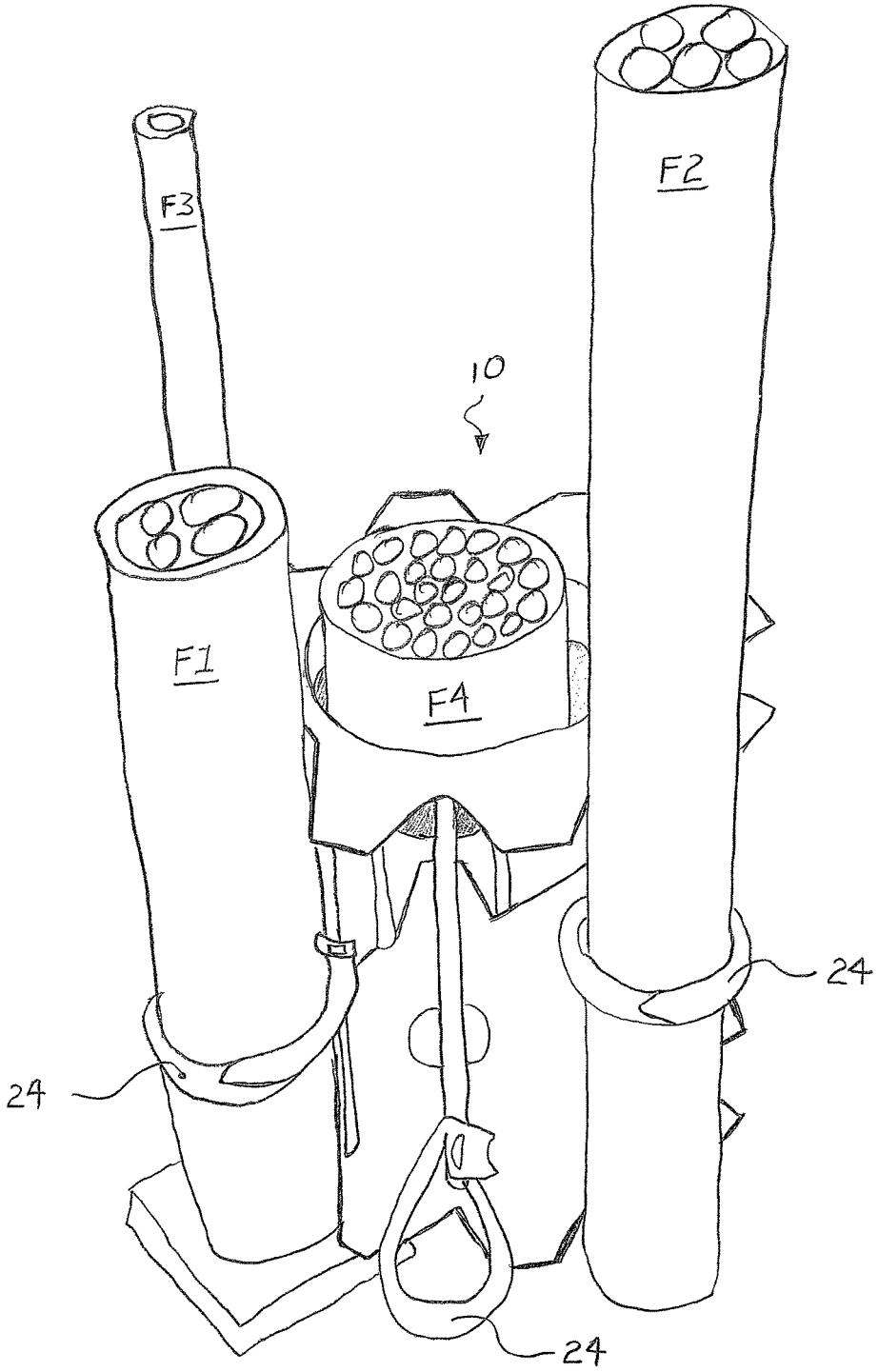
FIG. 7 is a top perspective view of the firework launching stand of FIG. 1, with several fireworks received within respective inlets thereof and within a central opening thereof.

FIG. 7 is a top perspective view of the firework launching stand 10, with fireworks F1, F2, F3 received within respective inlets 20*a*, 20*b* and firework F4 received via central opening 19 and being supported in platform 21. It can be seen that not all inlets 20*a*, 20*b* need to receive respective fireworks in order for the firework launching stand 10 to provide stability. Furthermore, because platform 21 is recessed with respect to central opening 19, the combination of central opening 19 and platform 21 serve to provide a degree of containment of firework F4 even once activated. While there may be some movement of firework F4 during activation if it has a smaller diameter than central opening 19, firework F4 is less likely to tip over during this time and send salvos towards spectators than if it were simply placed alone on the ground. One or more additional securing members 24 may be employed to better secure fireworks such as firework F4 within central opening 19 if risk of firework F4 tipping over during activation is of concern.

Figure 8:
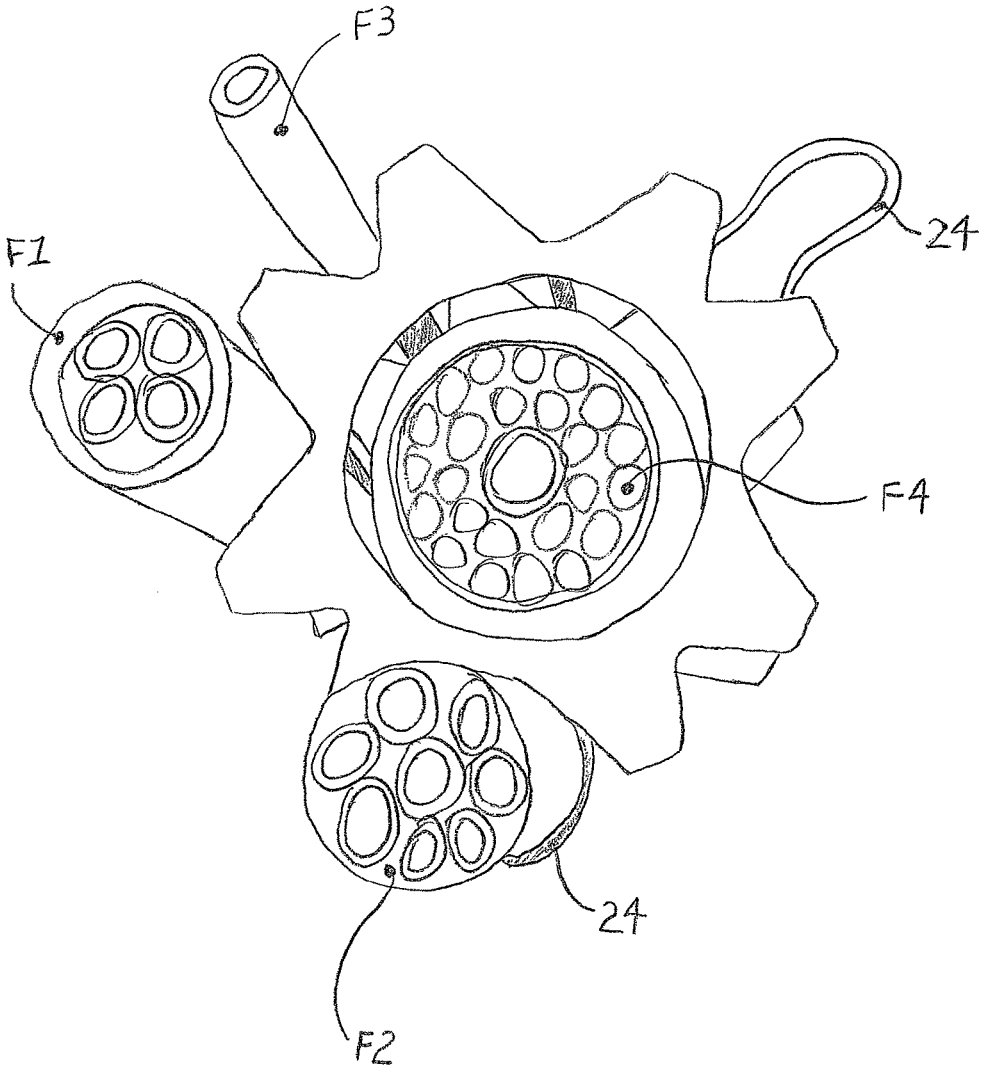
FIG. 8 is a top view if the firework launching stand of FIG. 1, with several fireworks received within respective inlets thereof and within a central opening thereof.

FIG. 8 is a top view if the firework launching stand of FIG. 1, with fireworks F1, F2, F3 received within respective inlets 20*a*, 20*b* and firework F4 received via central opening 19 and being supported in platform 21.

During use, fireworks such as fireworks F1-F4 can be received by and secured to the firework launching stand 10. Their fuses may be connected together for single point ignition, or connected to a control system (not shown) for controlling ignition. The combination of the firework launching stand 10 and the secured firework(s) is then placed onto a surface such as a lawn, a driveway, a parking lot, or other surface. The firework launching stand 10 lends significant stability to the firework(s) secured at inlets 20*a* or 20*b* due primarily to the firework launching stand 10, when secured to one or more fireworks, increasing the overall width to height ratio (ie., wider base) as compared to the fireworks alone. This reduces the chance of tipping during activation of the firework. Stability is also leant to the firework(s) supported on platform 21 because it is recessed with respect to central opening 19 enabling the circular wall of central opening 19 to act as a stabilizer should it be required.

The anchoring members may be removed so that the firework launching stand 10 can be used on hard surfaces such as asphalt and concrete, so as to maintain a low centre of gravity. Optionally, spikes 40 are connected to base 14 and may be inserted into a suitable ground surface (such as a grassy lawn or other surface able to receive the spikes 40) thereby to secure firework launching stand 10 to the ground while maintaining the low centre of gravity.

Although embodiments have been described with reference to the drawings, those of skill in the art will appreciate that variations and modifications may be made without departing from the spirit, scope and purpose of the invention as defined by the appended claims.

Figure 9:
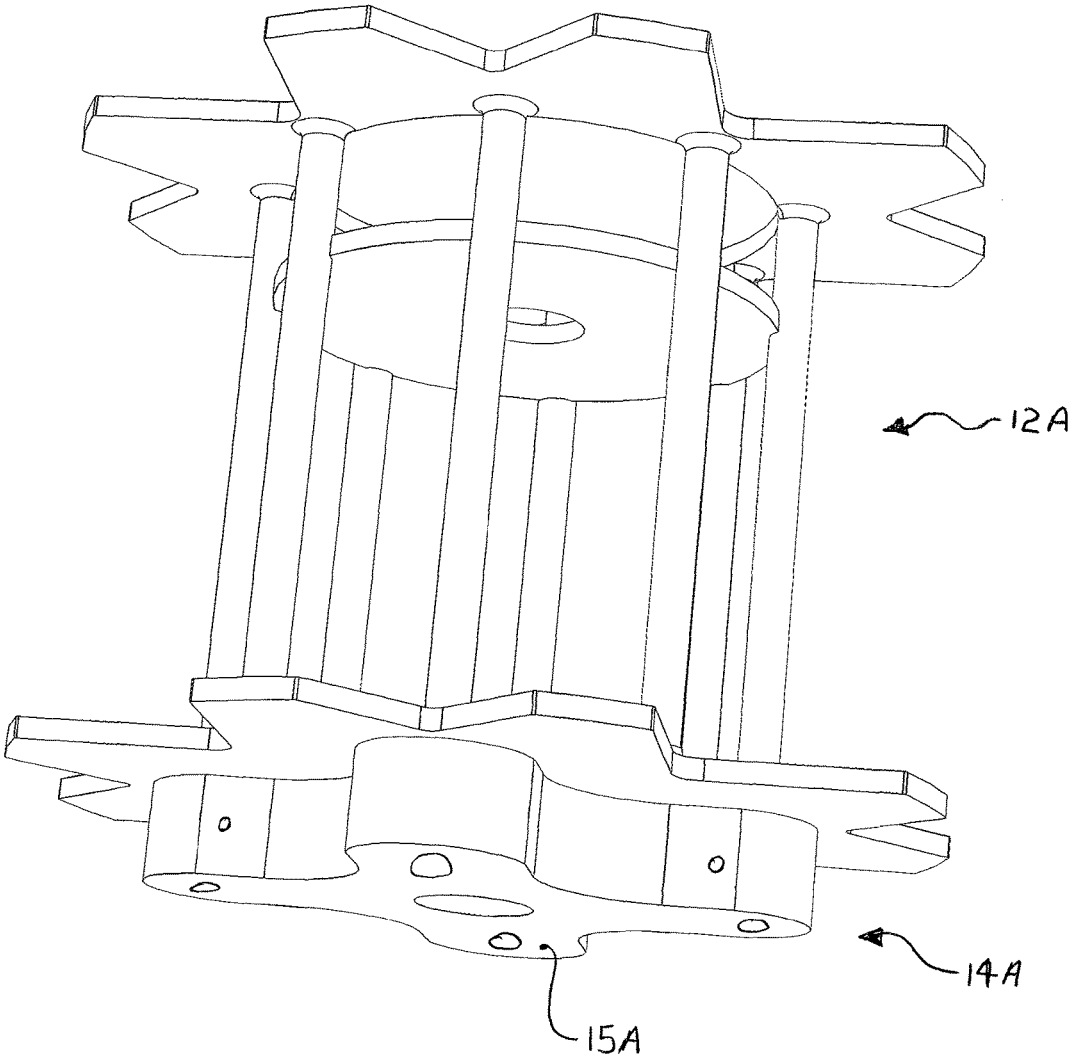
FIG. 9 is a bottom perspective view of the hub of an alternative firework launching stand, with a single leg having an aperture for receiving a single anchoring member.

For example, FIG. 9 is a bottom perspective view of the hub of an alternative firework launching stand 12A, with a base 14A comprising a single leg member 15A having an aperture for receiving a single anchoring member.

In an embodiment, the firework launching stand 10 may be made of a material other than steel, such as some other metal, or plastic or the like. The firework launching stand may be made of more than one such material.

In an embodiment, the anchoring members are not removable.

In an alternative embodiment of the firework launching stand, all inlet mouths are the same width. In another alternative embodiment of firework launching stand, only one inlet mouth differs in width from all of the others. In yet another embodiment, there is only one inlet at the periphery of the hub.

It will be understood that, in an alternative embodiment, the inlets 20*a*, 20*b* may each be a continuous channel running from the top of the firework launching stand 10 towards the bottom, rather than having separated upper and lower portions. In yet another embodiment, one or more middle hub members may be provided having middle portion(s) of each inlet 20*a*, 20*b*.

What is claimed is:

1. A firework launching stand comprising:

an upwardly-extending stabilizing hub;

a plurality of inlets at the periphery of the hub, each inlet having an open mouth at the periphery that is open to receive a respective firework being entered sideways into the inlet, each inlet tapering inwardly in width; and for each of the inlets, at least one respective strap associated with the inlet for temporarily securing to the hub a respective firework received within the inlet, wherein the at least one strap respectively associated with each inlet enables the temporary securing of a respective firework received within the inlet to the hub to be done independently of the temporary securing of another firework received within another inlet to the hub;

wherein the hub comprises:

a base;

a lower hub member supported by the base and incorporating a lower portion of each inlet;

an upper hub member supported above the lower hub member and incorporating an upper portion of each inlet;

wherein the firework launching stand comprises a plurality of pillars for supporting the upper hub member above the lower hub member;

wherein each respective strap is associated with a respective one of the pillars.

2. The firework launching stand of claim 1, wherein the base comprises a plurality of legs extending a fixed distance below the lower hub member.

3. The firework launching stand of claim 2, wherein each of the legs is dimensioned to removably receive a respective spike for temporarily anchoring the hub to the ground.

4. The firework launching stand of claim 1, wherein the upper hub member comprises a central opening and the hub further comprises:

a platform aligned with and recessed below the central opening, wherein one or more fireworks are receivable through the central opening for being supported on the platform.

5. The firework launching stand of claim 1, wherein there is a plurality of inlets at the periphery of the hub, and all of the mouths of the inlets are of the same width.

6. The firework launching stand of claim 1, wherein there is a plurality of inlets at the periphery of the hub, and the mouth of at least one of the inlets is narrower than the mouth of at least one of the other inlets.

7. The firework launching stand of claim 1, wherein each inlet tapers inwardly from its mouth to a respective point.

8. The firework launching stand of claim 1, wherein each respective strap is dimensioned to encircle a respective firework when the respective firework is received within a respective inlet.

9. A firework launching stand comprising:

an upwardly-extending stabilizing hub;

a plurality of inlets at the periphery of the hub, each inlet having an open mouth at the periphery that is open to receive a respective firework being entered sideways into the inlet, each inlet tapering inwardly in width; and for each of the inlets, at least one respective strap associated with the inlet for temporarily securing to the hub a respective firework received within the inlet, wherein the at least one strap respectively associated with each inlet enables the temporary securing of a respective firework received within the inlet to the hub to be done independently of the temporary securing of another firework received within another inlet to the hub, wherein the hub comprises:

a base;

a lower hub member supported by the base and incorporating a lower portion of each inlet;

an upper hub member supported above the lower hub member and incorporating an upper portion of each inlet, wherein the upper hub member comprises a central opening and the hub further comprises:

a platform aligned with and recessed below the central opening, wherein one or more fireworks are receivable through the central opening for being supported on the platform.

10. The firework launching stand of claim 9, wherein the base comprises a plurality of legs extending a fixed distance below the lower hub member.

11. The firework launching stand of claim 10, wherein each of the legs is dimensioned to removably receive a respective spike for temporarily anchoring the hub to the ground.

12. The firework launching stand of claim 9, wherein there is a plurality of inlets at the periphery of the hub, and all of the mouths of the inlets are of the same width.

13. The firework launching stand of claim 9, wherein there is a plurality of inlets at the periphery of the hub, and the mouth of at least one of the inlets is narrower than the mouth of at least one of the other inlets.

14. The firework launching stand of claim 9, wherein each inlet tapers inwardly from its mouth to a respective point.

15. The firework launching stand of claim 9, wherein each respective strap is dimensioned to encircle a respective firework when the respective firework is received within a respective inlet.

16. The firework launching stand of claim 9, wherein the firework launching stand comprises a plurality of pillars for supporting the upper hub member above the lower hub member, and each respective strap is associated with a respective one of the pillars.

* * * * *